US011125041B2

(12) United States Patent
Bay et al.

(10) Patent No.: US 11,125,041 B2
(45) Date of Patent: Sep. 21, 2021

(54) SUBSEA MODULE AND DOWNHOLE TOOL

(71) Applicants: Aker Solutions, Inc., Houston, TX (US); Baker Hughes Incorporated, Houston, TX (US)

(72) Inventors: Lars Bay, Katy, TX (US); Terry R. Bussear, Spring, TX (US)

(73) Assignees: Aker Solutions Inc., Houston, TX (US); Baker Hughes Incorporated, Houston, TX (US)

( * ) Notice: Subject to any disclaimer, the term of this patent is extended or adjusted under 35 U.S.C. 154(b) by 0 days.

(21) Appl. No.: 16/343,555

(22) PCT Filed: Oct. 6, 2017

(86) PCT No.: PCT/US2017/055518

§ 371 (c)(1),
(2) Date: Apr. 19, 2019

(87) PCT Pub. No.: WO2018/075267

PCT Pub. Date: Apr. 26, 2018

(65) Prior Publication Data

US 2020/0048977 A1 Feb. 13, 2020

Related U.S. Application Data

(63) Continuation of application No. 15/331,191, filed on Oct. 21, 2016, now abandoned.

(Continued)

(30) Foreign Application Priority Data

Feb. 7, 2017 (NO) ..... 20170181

(51) Int. Cl.
*E21B 33/035* (2006.01)
*E21B 33/04* (2006.01)

(52) U.S. Cl.
CPC ..... *E21B 33/0355* (2013.01); *E21B 33/04* (2013.01)

(58) Field of Classification Search
CPC ..... E21B 33/0355; E21B 33/04
See application file for complete search history.

(56) References Cited

U.S. PATENT DOCUMENTS 4,892,149 A 1/1990 Hoes et al.
6,330,919 B1 12/2001 McGarian
(Continued)

OTHER PUBLICATIONS

International Search Report and Written Opinion issued in related PCT Application No. PCT/US2017/055518, dated Jan. 17, 2018, 18 pages.

(Continued)

*Primary Examiner* — Aaron L Lembo
(74) *Attorney, Agent, or Firm* — Baker Botts L.L.P.

(57) ABSTRACT

A system including a subsea module, a tool hanger, and an in-well tool string coupled to and extending from a lower portion of the tool hanger is provided. The subsea module includes a subsea spool with a main bore formed therethrough, and the main bore includes a tool hanger interface. The subsea module also includes a connector for mounting the subsea module on a subsea component, wherein the connector includes a grip configured to engage the subsea component, and a first seal coupled to the connector and configured to seal the connector against the subsea component. The tool hanger is disposed within the main bore and coupled to the tool hanger interface via at least a second seal configured to seal the tool hanger against the main bore of the subsea spool. The in-well tool string is configured to couple the tool hanger to an in-well tool.

10 Claims, 13 Drawing Sheets

Related U.S. Application Data

(60) Provisional application No. 62/415,340, filed on Oct. 31, 2016.

(56) References Cited

U.S. PATENT DOCUMENTS

| | | | | |
|---|---|---|---|---|
| 7,416,020 | B2 | 8/2008 | Duhn et al. | |
| 8,794,334 | B2 * | 8/2014 | June | E21B 33/035 166/368 |
| 9,863,207 | B2 * | 1/2018 | Stubbeman | E21B 34/04 |
| 10,094,178 | B2 * | 10/2018 | Bergeron | E21B 17/07 |
| 2004/0104024 | A1 | 6/2004 | Kent et al. | |
| 2006/0042799 | A1 | 3/2006 | Hosie et al. | |
| 2009/0255682 | A1 | 10/2009 | Voss et al. | |
| 2010/0163244 | A1 | 7/2010 | Desai et al. | |
| 2012/0273219 | A1 | 11/2012 | Hoffman et al. | |
| 2013/0248200 | A1 | 9/2013 | June et al. | |
| 2014/0326470 | A1 | 11/2014 | Tinnen | |
| 2015/0247371 | A1 | 9/2015 | Kekarainen | |
| 2016/0017683 | A1 | 1/2016 | Hufthammer | |
| 2016/0024896 | A1 | 1/2016 | Johnson et al. | |
| 2016/0076341 | A1 | 3/2016 | Burguieres et al. | |

OTHER PUBLICATIONS

Subsea wellhead systems; SPE International, Jun. 26, 2015; 9 pages; retrieved from the Internet: http://petrowiki. Drg/index.php?title=Subsea_wellhead_systems.

International Search Report and the Written Opinion of the International Searching Authority, or the Declaration; PCT/US2017/052626; dated Dec. 14, 2017, 10 pages.

* cited by examiner

SUBSEA MODULE AND DOWNHOLE TOOL

CROSS REFERENCE TO RELATED APPLICATIONS

The present application is a U.S. National Stage Application of International Application No. PCT/US2017/055518 filed Oct. 6, 2017, which claims priority to U.S. patent application Ser. No. 15/331,191, entitled "Wellhead Based Well Control Arrangement for Upper Plug and Abandonment Operations and Method", filed on Oct. 21, 2016 and; U.S. Provisional Patent Application No. 62/415,340 entitled "Subsea Module, Tool Hanger" filed on Oct. 31, 2016, and; Norwegian Patent Application No. 20170181, entitled "Subsea Module and Downhole Tool" filed on Feb. 7, 2017. All of these applications are hereby incorporated by reference in their entirety and for all purposes.

TECHNICAL FIELD

The present disclosure relates generally to subsea wells and, more particularly, to a system and method for operating a subsea module and downhole tool string in subsea wells.

BACKGROUND

Hydrocarbon production wells typically have a limited useful lifespan. Various physical, chemical, and/or financial factors may result in the abandonment of production from a well, ostensibly leaving the well in a condition in which it does not adversely affect the environment (e.g., by leaking).

The permanent abandonment of a production well typically requires the pulling of certain subterranean components (e.g., a completion), plugging the well to prevent fluid flow into and out of the well, isolation of the wellbore, isolation of the annuli, the removal of structural components near the top of the well (e.g., the wellhead) and the like. Such processes typically entail the use of complex equipment. Typically several plugs are placed in the well to provide for redundancy.

Plug and abandonment processes are challenging for subsea wells. High pressures and long distances between the water surface and seafloor typically require the use of expensive, heavy equipment. Many procedures typically require the use of a semi-submersible vessel, which is expensive to operate. Minimizing the usage time of such vessels reduces the overall cost of permanently plugging and abandoning a well. Logging, accessing and plugging the various annuli of a typical subsea well may be particularly challenging.

The regulatory requirements for plug and abandonment operations vary. Typically, abandonment requires a substantially "permanent" or "eternal" perspective. The wellhead and upper casing typically needs to be removed down to at least several meters below the seabed. At least two permanent barriers between the reservoir and the surface (or seafloor) are required, and reservoir/casing/tubing integrity must be sufficient to prevent leakage around the plugs. Control cables and lines should typically be removed. The position, integrity, and functionality of the barriers should generally be verifiable after installation.

It is now recognized that a need exists for relatively lightweight systems that can be deployed without the use of a semi-submersible vessel to perform plug and abandonment operations on subsea wells while meeting all regulatory requirements.

SUMMARY

Various aspects of the present disclosure are described in the context of a subsea implementation. Certain systems and methods described herein may be used in onshore or topside implementations.

Presently disclosed embodiments are directed to a system including a subsea module, a tool hanger, and an in-well tool coupled to and extending from a lower portion of the tool hanger. The subsea module includes a subsea spool with a main bore formed therethrough, and the main bore includes a tool hanger interface. The subsea module includes a component connector for mounting the subsea module on another subsea component, particularly a wellhead, a spool, or a tree. The component connector includes a grip configured to engage the subsea component, and a first seal coupled to the component connector and configured to seal the component connector against the subsea component, particularly an inside and/or top surface of the subsea component. The tool hanger is disposed within the main bore of the subsea spool and coupled to the tool hanger interface via at least a second seal configured to seal the tool hanger against the main bore of the subsea spool.

In addition, presently disclosed embodiments are directed to a method including landing a subsea module on a subsea component, wherein the subsea module includes a subsea spool with a main bore formed therethrough, wherein the subsea module is coupled to a tool hanger disposed within the main bore of the subsea spool, and wherein an in-well tool string extends downward from the tool hanger. The method also includes sealing a first seal of the subsea module to the subsea component, particularly against at least one of an inside surface and a top of the subsea component, particularly to a top interior edge of the subsea component. The method further includes sealing the tool hanger against the main bore of the subsea spool via at least a second seal.

Embodiments are also directed to a subsea module including a subsea spool with a main bore formed therethrough, the main bore including a tool hanger interface. The subsea module also includes a component connector for mounting the subsea module on a subsea component, particularly a wellhead, a spool, or a tree. The component connector includes a grip configured to engage the subsea component, particularly along an outside surface of the subsea component. The subsea module also includes a first seal coupled to the component connector and configured to seal the component connector to the subsea component, particularly against an inside surface of the subsea component. The subsea module further includes at least one of a circulation block and a return block. The circulation block includes a circulation conduit formed therethrough, the circulation conduit configured to be coupled to an interior of an in-well tool string via a circulation line within a tool hanger positioned in the main bore of the subsea spool, and a circulation line termination configured to couple the circulation conduit to a circulation downline. The return block includes a return conduit formed therethrough, the return conduit configured to be coupled to an annulus formed between an interior of the subsea component and an exterior of the in-well tool string, and a return termination configured to couple the return conduit to a return downline.

Embodiments are also directed to an assembly including tool hanger having an outer circumference and including: a seal disposed on the outer circumference and configured to seal the tool hanger against an interior surface of a main bore of a spool, particularly a subsea spool; and a locking arrangement disposed on the outer circumference and configured to lock the tool hanger against the interior surface. The assembly also includes an in-well tool string coupled to and extending from a lower portion of the tool hanger, the in-well tool string configured to suspend an in-well tool from the tool hanger. The assembly further includes at least one circulation line fluidically coupling an exterior of the tool hanger, particularly at least one of a top and the outer circumference of the tool hanger, to an interior of the in-well tool string.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
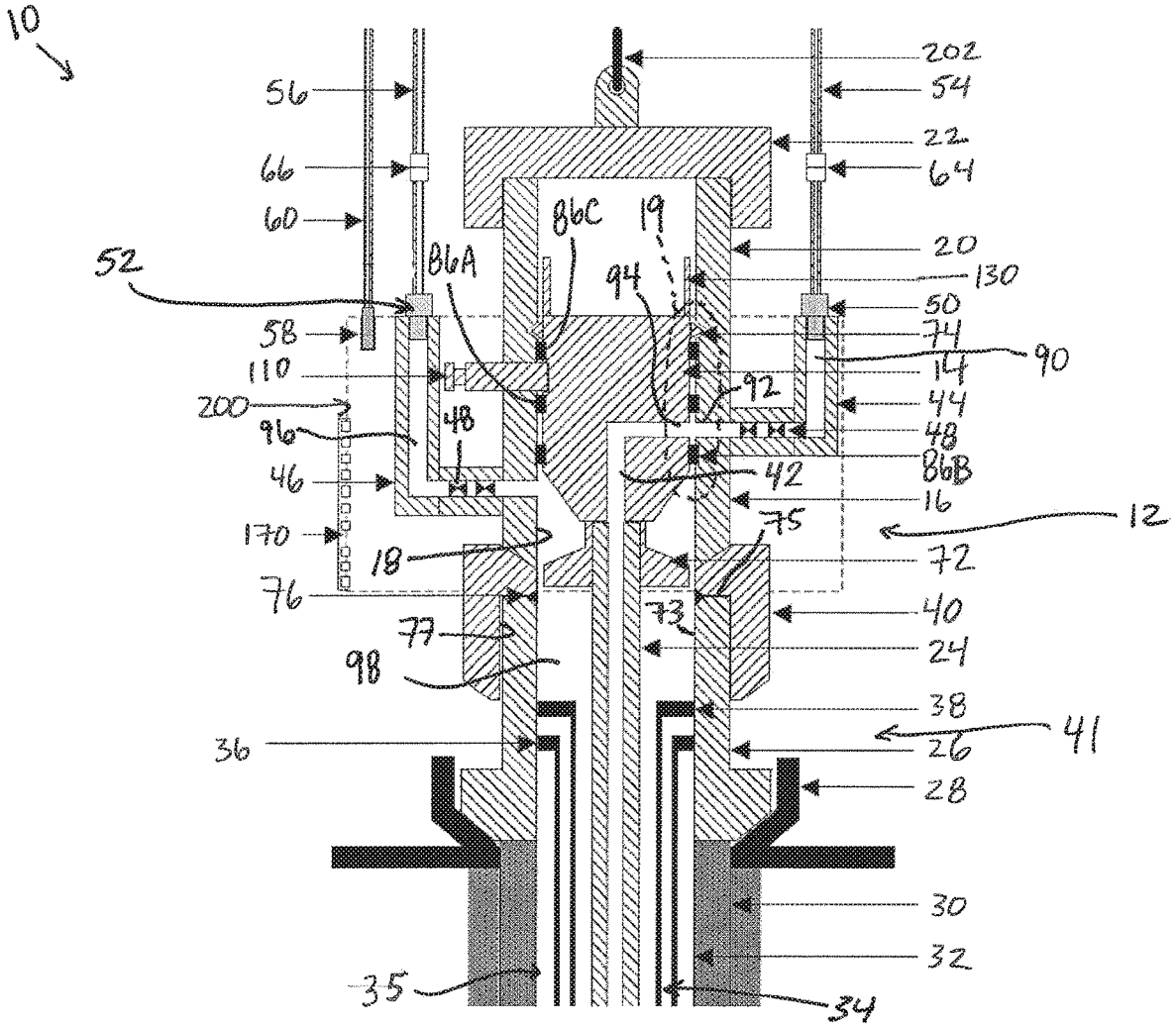
FIG. 1 is a schematic diagram of a subsea module with a tool hanger and suspended in-well tool connected thereto, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure. Although various aspects are described in the context of a subsea implementation, certain systems and method described herein may be used in onshore or topside implementations.

Embodiments of the present disclosure are directed to systems and methods for operating a subsea module and connected in-well tool string in a subsea well. The disclosed subsea operations may include plug and abandonment operations performed at the end of the usable life of a subsea well, among other operations. Plug and abandonment of a production well generally involves pulling certain subterranean components (e.g., a completion) from the well, plugging the well to prevent fluid flow into and out of the well, isolation of the wellbore, isolation of the annuli, and the removal of structural components near the top of the well, among others. The disclosed systems and methods may be used to cap the well by cementing or plugging the top of the well to isolate the wellbore and annuli before removing the wellhead.

Hydrocarbon wells may benefit from the ability to removably insert various tools into the well (e.g., via a wireline, slickline, or coiled tubing, and through a riser/BOP of light well intervention system). The disclosed systems may include a subsea module having a spool used to removably couple (e.g., land, lock, and seal) a tool hanger to a subsea component (e.g., subsea wellhead, subsea tree, or another subsea module). The tool hanger may be configured to couple an in-well tool string to the spool and to facilitate communication with the downhole tool. The subsea spool may have an inner diameter sized such that the tool hanger, downhole tool, and/or casing strings may be pulled up through the spool (e.g., via a riser system). The subsea module may be mounted and sealed to the subsea component (e.g., wellhead, tree, or other module) via a grip interfacing with an outer surface of the subsea component and a first seal interfacing with the inner surface of the subsea component. In addition, one or more seals are present between the internal surface of the spool and the tool hanger. The various sealing elements may replace the function of a second inflatable packer that is often used in existing plug and abandonment tools.

The disclosed system and method may be particularly useful in subsea/deepwater well plug and abandonment (P&A) operations. Typical P&A operations utilize heavy equipment that is generally deployed from semi-submersible rigs equipped with a derrick and moon pool to cement or plug the top of the well. Due to the high daily operating costs of such semi-submersible rigs, it is desirable to provide methods for isolating the upper wellbore annuli in P&A operations with equipment that can be deployed from smaller multi-purpose vessels. The disclosed system may utilize a subsea module and tool hanger that, when used in conjunction with an in-well tool, may enable an operator to isolate the upper annuli of the well in a single trip where full well control is maintained throughout the operations. Certain aspects of the disclosed system allow for the possibility to pull parts of the system through a marine riser for contingency purposes without losing the required barriers between the reservoir and the surface.

Turning now to the drawings, FIG. 1 illustrates an example subsea system 10 having a subsea module 12 and a tool hanger 14, in accordance with the present disclosure. The subsea module 12 generally includes a subsea spool 16 having a main bore 18 formed therethrough to receive the tool hanger 14. The main bore 18 may include a tool hanger interface 19 designed to receive and engage with the tool hanger 14. For example, the tool hanger interface 19 may include at least one of a groove or seal surface formed along the interior surface of the main bore 18 of the subsea spool 16 that interfaces with a locking arrangement and/or seal of the tool hanger 14, The inner diameter of the main bore 18 of the subsea spool 16 may be sized such that the tool hanger 14 and any connected well tubulars or tools may be selectively pulled through the spool 16 (e.g., via a riser system). The subsea module 12 may include a re-entry mandrel 20 at an upper portion thereof, and the re-entry mandrel 20 may interface with a debris cap 22, which is described in detail below.

The tool hanger 14 may be received within the subsea spool 16 and coupled to the tool hanger interface 19 of the subsea spool 16, as shown. The tool hanger 14 may be coupled at a lower portion to an in-well tool string 24, as shown. The in-well tool string 24 may be configured to couple the tool hanger 14 to an in-well tool. The tool hanger 14 may also provide a communication interface for the in-well tool string 24 and attached in-well tool, as described in greater detail below.

As illustrated, the system 10 including the subsea module 12, the tool hanger 14, and the suspended in-well tool string 24 may be landed on a wellhead 26, as illustrated. However, it should be noted that the system 10 may be landed on other types of subsea equipment (i.e., "subsea component"), as described in greater detail below. The wellhead system 26 may include a high pressure wellhead that has been landed in a low pressure housing 28 and a conductor 30 installed through the sea floor. Multiple casing strings (e.g., large bore casing 32 and small bore casing 34 may be extended down a subsea wellbore 35 and suspended from respective casing hangers 36 and 38 mounted in the wellhead 26. As illustrated, the subsea module 12 may be equipped with a component connector (e.g., a wellhead connector) 40 designed to land on and interface directly with an upper end of a subsea component 41. The subsea component 41 in FIG. 1 may include the wellhead 26. As described below, the component connector 40 may be designed to land on and interface directly with other types of subsea components 41 such as, for example, a subsea tree or subsea spool coupled directly or indirectly to the wellhead 26.

Figure 2:
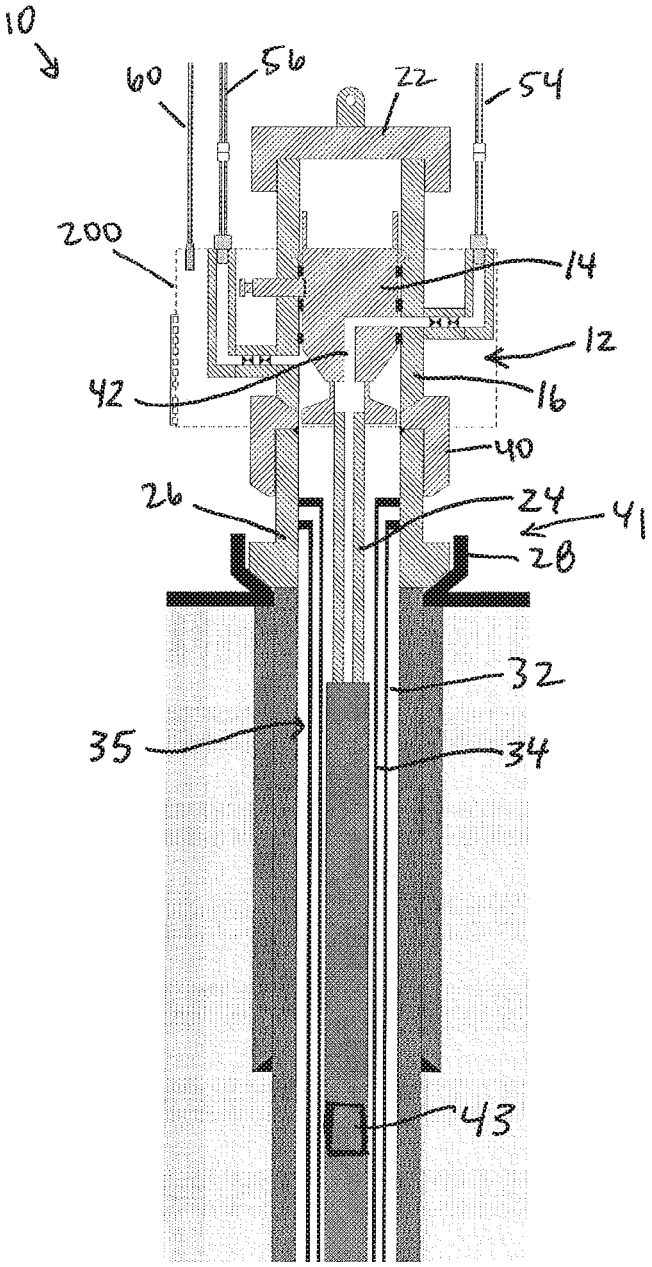
FIG. 2 is a schematic diagram of the subsea module and the tool hanger of FIG. 1 installed on a subsea wellhead with the suspended tool extending into a wellbore, in accordance with an embodiment of the present disclosure.

FIG. 2 illustrates the subsea module 12, tool hanger 14, and the connected in-well tool string 24 being used to suspend the in-well tool 43 within the subsea wellbore 35. More specifically, the tool hanger 14 is used to connect the in-well tool string 24 to the subsea module 12 such that the in-well tool 43 is suspended downhole through the small bore casing 34. In some embodiments, the in-well tool 43 may include a perforation tool and/or a packer tool designed to fill a downhole volume with a plugging media (e.g., cement). Such an in-well tool 43 may be utilized for capping a wellbore during a plug and abandonment operation subsequent to the application of a cement plug in the main inner diameter of the well (e.g., located below the portion illustrated in the figure). However, other types of in-well tools 43 may also be extended into the wellbore 35 via the in-well tool string 24 and the tool hanger 14 positioned in the subsea spool 16. The tool hanger 14 may include a circulation line 42 and/or a return line (not shown) configured to provide fluid to the in-well tool string 24 or to spaces surrounding the in-well tool string 24.

Turning back to FIG. 1, the subsea module 12 may include a circulation block 44, a return block 46, or both as illustrated. The circulation block 44 may couple the subsea module 12 to the circulation line 42 of the tool hanger 14. The return block 46 may couple the subsea module 12 to an annulus 98 below the tool hanger 14, as shown. However, the positions of these blocks 44 and 46 and their corresponding lines through/around the tool hanger 14 may be reversed. For example, the circulation block 44 may couple the subsea module 12 to an annulus 98 below the tool hanger 14 while the return block 46 may couple the subsea module 12 to a return line of the tool hanger 14. In still other instances, both the circulation and return blocks 44 and 46 may couple the subsea module to the corresponding circulation line 42 and a return line (not shown) routed through the tool hanger 14.

The illustrated system 10 may be a plug and abandonment (P&A) system including a subsea module 12 furnished with multiple barrier devices 48, the component connector 40, a re-entry mandrel 20, and an interface to one or multiple pump-down lines and umbilicals. For example, the subsea module 12 may include a circulation hose termination 50 and a return termination 52 used to connect the corresponding circulation and return blocks 44 and 46 of the spool 16 to downlines 54 and 56, respectively. The system 10 may utilize two downlines 54 and 56, where one downline 54 may be used as a circulation line to pump in a medium (e.g., cement), and the other downline 56 may be used as a return line to enable circulating capabilities. The subsea module 12 may also include an umbilical termination 58 used to connect one or more internal communication components of the subsea module 12 to an umbilical 60. These terminations 50, 52, and 58 may be wet mate make-and-break terminations or hot make/break connections designed to enable disconnection and reconnection of the downlines 54 and 56 and umbilical 60 subsea without pulling any subsea equipment to the surface.

Figure 3:
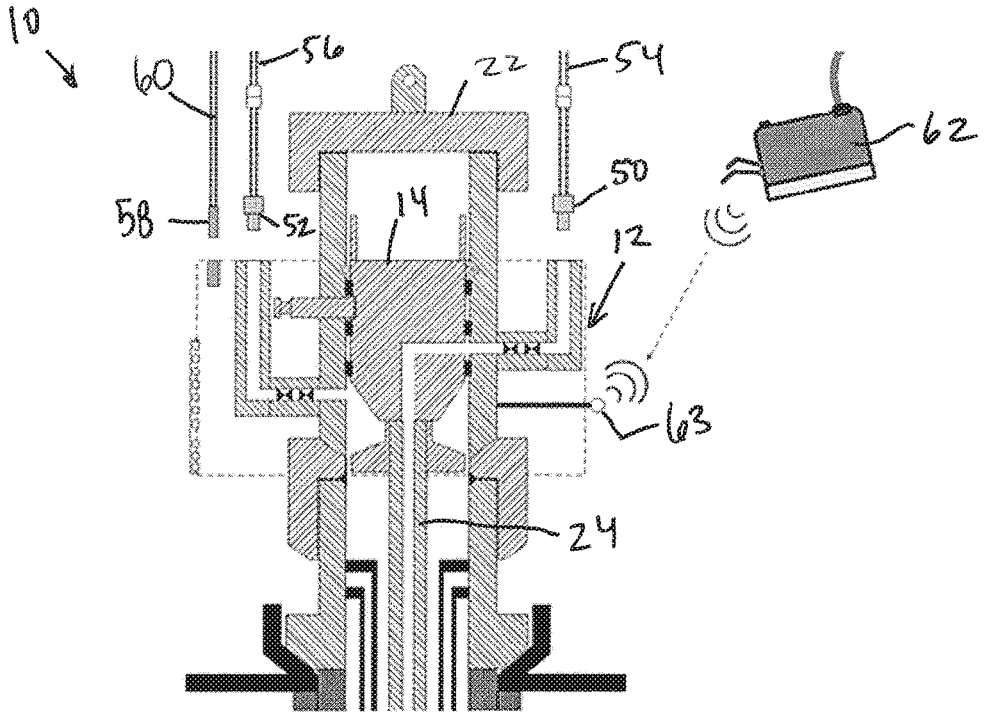
FIG. 3 is a schematic diagram of the subsea module and tool hanger of FIG. 1 showing a wireless activation of barrier devices and line disconnection, in accordance with an embodiment of the present disclosure.

FIG. 3 illustrates these downlines 54 and 56 and the umbilical 60 being disconnected from the corresponding terminations 50, 52, and 58 on the subsea module 12. This disconnection may be initiated via wireless signals from a remotely operated vehicle (ROV) 62, as shown. An acoustic receiver 63 on the subsea module 12 may receive acoustic signals from the ROV 62 and output control signals to various components of the subsea module 12 to initiate shutdown. Specifically, the control signals may activate the barrier devices 48 of the subsea module 12 and actuate the terminations 50, 52, and 58 to disconnect the lines 54 and 56 and umbilical 60 from the subsea module 12.

Figure 4:
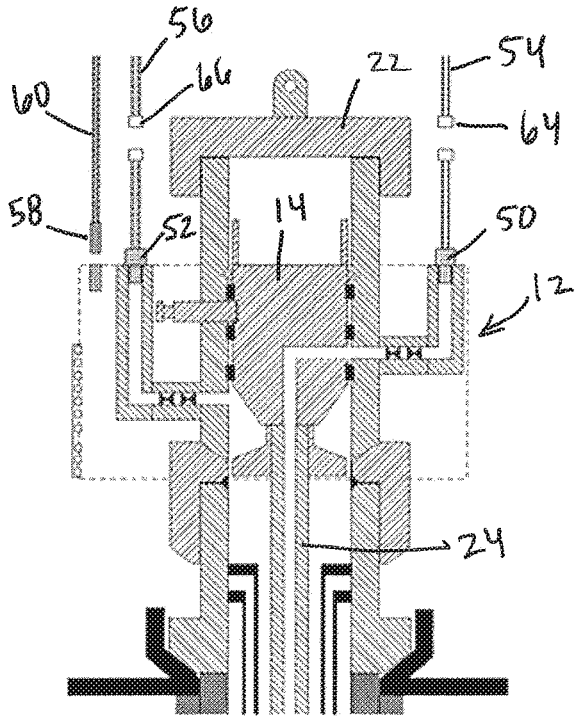
FIG. 4 is a schematic diagram of an emergency disconnect operation of the subsea module of FIG. 1 and its associated lines, in accordance with an embodiment of the present disclosure.

The pump-down lines (i.e., downlines 54 and 56) may each include a mid-line weak link 64 and 66, respectively, which may be activated in emergency situations (e.g., vessel drive off, topside incidents, etc.) to separate the equipment installed on the seabed from the vessel. FIG. 4 illustrates the system 10 with these downlines 54 and 56 disconnected at the mid-line weak links 64 and 66 to disconnect the topsides equipment (e.g., vessel) from the subsea module 12. In addition, FIG. 4 shows the umbilical 60 disconnected from the subsea module 12 at the umbilical termination 58 to disconnect the topsides equipment from the subsea module 12. In an emergency disconnect situation, the downlines 54 and 56 may be disconnected at the mid-line weak links 64 and 66 in response to excessive tension in the lines 54 and 56. In some instances, the mid-line weak links 64 and 66, upon disconnection, may initiate closure of the barrier devices 48 and umbilical disconnect. Clump weights may be used on the downlines 54 and 56 if needed.

The through-bore 18 of the subsea module 12 may have an inner diameter approximately the same size as the inner diameter of a blow-out preventer (BOP) that can be attached to the system 10. This may enable the tool hanger 14 and connected in-well tool string 24 to be selectively pulled from the well while the subsea module 12 remains installed. This process of pulling the in-well tool string 24 is illustrated and described in detail below with reference to FIGS. 8-10 and 19.

Turning back to FIG. 1, the inner spool wall of the subsea module 12 may be equipped with a suitable landing system, which may include orientation and landing mechanisms, as well as a sealing arrangement (e.g., seals 86). These may allow the tool hanger 14 with the suspended in-well tool string 24 to be oriented, landed, locked, and sealed off inside the subsea module 12. As an example, the landing mechanisms may include an orientation feature designed to interface with an orientation sleeve 72 on the tool hanger 14 and/or the in-well tool string 24. The landing mechanisms may also include a locking arrangement 74 formed between the tool hanger 14 and the internal bore surface of the spool 16, as illustrated. It should be noted that other types, sizes, shapes, and arrangements of landing mechanisms may be utilized in other embodiments.

The subsea module 12 may include at least a first seal 76 formed between the subsea module 12 and the subsea equipment onto which the subsea module 12 is landed and connected. For example, in FIG. 1, the first seal 76 is formed between the component connector 40 of the subsea module 12 and the wellhead 26. The first seal 76 may be configured to seal the component connector 40 against an inside surface 73 of the subsea component 41, a top 75 of the subsea component 41, or both (i.e., a top interior edge of the subsea component 41 as shown).

The component connector 40 of the subsea module 12 may also include a grip 77 that interfaces with and engages the wellhead 26. For example, as shown, the grip 77 may engage the wellhead 26 along an outer surface of the wellhead 26. The grip 77 may include one or more grip elements (not shown) such as protrusions extending radially inward from the interior surface of the component connector 40. The grip 77 may generally include any desired surface or surface mounted component designed to form an industry standard connection between a spool and a subsea component 41.

The first seal 76 provides a fluidic seal that helps to retain wellbore, formation, and other fluids within the system 10. The first seal 76 may include an annular compression-type seal having one or more seal elements designed to seal against one or more surfaces of the subsea component 41. Additional sealing arrangements (e.g., via an isolation sleeve) may be utilized between the component connector 40 and the wellhead 26 to form the fluidic seal. This may be particularly useful in aged wellheads 26, where otherwise critical seal surfaces may have previously become damaged.

The first seal 76 may create a pressure seal against a surface of the wellhead 26 to contain any pressure that might exist outside either of the casing strings 32 and 34 for cementing purposes during a plugging and abandonment operation. The first seal 76 may also prevent circulating fluid leakage past the subsea module 12. Still further, the first seal 76 may replace the function of a second inflatable packer that might otherwise be used in the connected in-well tool string 24.

As illustrated, a circulation conduit 90 within the subsea module 12 may be routed from the circulation line termination 50, through the spool 16 of the subsea module 12, and into the through bore 18 of the subsea module 12. This circulation conduit 90 may be provided at least partially through the circulation block 44. When the tool hanger 14 is oriented and locked in place in the subsea module 12, a circulation outlet 92 from the subsea spool 16 may align with a circulation inlet 94 of the tool hanger 14. This alignment may enable fluid communication from the vessel to the wellbore 35 via the circulation downline 54, the subsea module 12, the tool hanger 14, and the suspended in-well tool string 24. As illustrated, the circulation block 44 may be equipped with one or multiple barrier devices 48 (e.g., barrier valves) to achieve sufficient well barriers throughout the operations.

Similarly, a return conduit 96 may be routed from the line termination 52 on the subsea module 12, through the return block 46 mounted to the subsea spool 16, and into the through bore 18 of the subsea module 12 underneath the location of the tool hanger 14. This routing may enable fluid communication from an annulus 98 around the in-well tool 24 string underneath the tool hanger 14 back to the vessel via the subsea module 12 and the return downline 56. As illustrated, the return block 46 may be equipped with one or multiple barriers devices 48 (e.g., barrier valves) to achieve sufficient well barriers throughout the operations.

In addition to the first seal 76 between the subsea module 12 and the wellhead 26, the system 10 may also include at least one second seal 86 between the subsea spool 16 and the tool hanger 14. For example, the illustrated system 10 includes one seal 86A positioned above the location where the circulation outlet 92 of the spool 16 is aligned with the circulation inlet 94 of the tool hanger 14, and another seal 86B positioned below the location of the circulation outlet 92 and the circulation inlet 94. Additional seals (e.g., 86C)

may be positioned between the spool 16 of the subsea module 12 and the tool hanger 14 as well.

Figure 5:
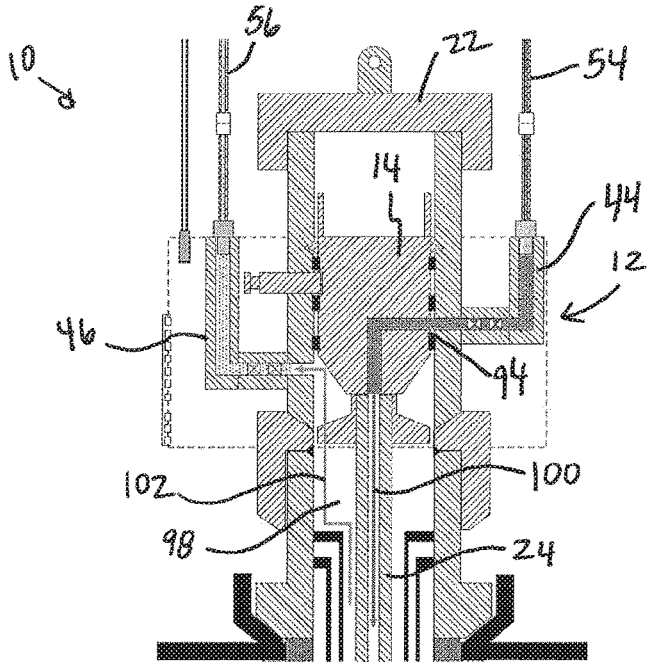
FIG. 5 is a schematic diagram illustrating a circulation path through the subsea module, tool hanger, and in-well tool of FIG. 1, in accordance with an embodiment of the present disclosure.

FIG. 5 provides a more detailed illustration of the method of circulating fluid through the disclosed subsea module 12, tool hanger 14, and in-well tool string 24. To enable circulation through the subsea module 12 and the tool hanger 14, there may be communication between an internal portion of the in-well tool string 24 coupled to the tool hanger 14 and the annulus 98 around the tool string 24. By pumping down the circulation downline 54, the medium may be forced through the circulation block 44 of the subsea module 12, into the tool hanger 14 via the circulation inlet 94, and down the internals of the in-well tool string 24, as shown by arrow 100. Returns may flow back up the annulus 98 surrounding the in-well tool string 24, through the return line in block 46 on the subsea module 12 upstream of the tool hanger 14, and into the return downline 56 connected to the subsea module 12, as shown by arrow 102.

Circulation may be performed in the opposite direction as well depending on the functionality of the in-well tool string 24. That is, instead of circulating a medium from the vessel down to the inside of the in-well tool string 24, out into the annulus 98, and back up to the vessel, the subsea module 12 and tool hanger 14 may be used to route the circulation medium from the vessel down the annulus 98 into the internal portion of the in-well tool string 24, and back up to the vessel. In some cases, the wellbore 35 may be isolated by closing the barrier devices 48 in the respective wing blocks 44 and 46.

Turning back to FIG. 1, the subsea module 12 and tool hanger 14 may be equipped with a line connection system 110, which enables various control lines to communicate between the subsea module 12 and the tool hanger 14. These control lines may include, for instance, hydraulic, electrical, and/or fiber optic lines used to operate and/or monitor equipment in the suspended in-well tool string 24. The line connection system 110 on the subsea module 12 may interface with a complementary receptacle on the tool hanger 14. The line connection system 110 on the subsea module 12 may be selectively stabbed into the receptacle on the tool hanger 14 to enable engagement and/or disengagement from the tool hanger 14. This movement of the line connection system 110 of the subsea module 12 relative to the tool hanger 14 may be controlled either remotely from the topsides facility or subsea using a standard ROV.

The subsea module 12 and tool hanger 14 may be able to provide control and monitoring functionality to the suspended in-well tool 43 in the subsea wellbore 35 via the line connection system 110, tool hanger 14, and in-well tool string 24. This control and monitoring functionality may include actuating the in-well tool 43. This may include, for example, firing and releasing one or more downhole perforating guns via a topside control system interfacing with the subsea module 12 and tool hanger 14 via the umbilical 60 and the line connection system 110. The actuation of the in-well tool 43 may also include inflating or deflating one or multiple downhole inflatable packer elements via a topside control system interfacing with the subsea module 12 and tool hanger 14 via the umbilical 60 and the line connection system 110.

As illustrated, the sealing arrangement between the subsea module 12 and the tool hanger 14 may be sufficient to seal off the circulation inlet 94 of the tool hanger 14 and the line connection system 110 from the well. This may be accomplished, as illustrated, via the seal 86A located between the circulation inlet 94 and the line connection system 110, and the seal 86B located between the circulation inlet 94 and the well annulus 98. In addition, the sealing arrangement may also include one or more seals 86C between the subsea module 12 and the tool hanger 14 at a position located above the line connection system 110 to isolate the interface between the line connection system 110 and the receptacle.

The tool hanger 14 may include a contingency neck profile 130 at its upper interface, as shown. This contingency neck profile 130 may be designed to allow for connection of a running tool to the tool hanger 14, thereby allowing the tool hanger 14 with the suspended in-well tool string 24 to be retrieved to the surface separately from the subsea module 12.

Figure 6:
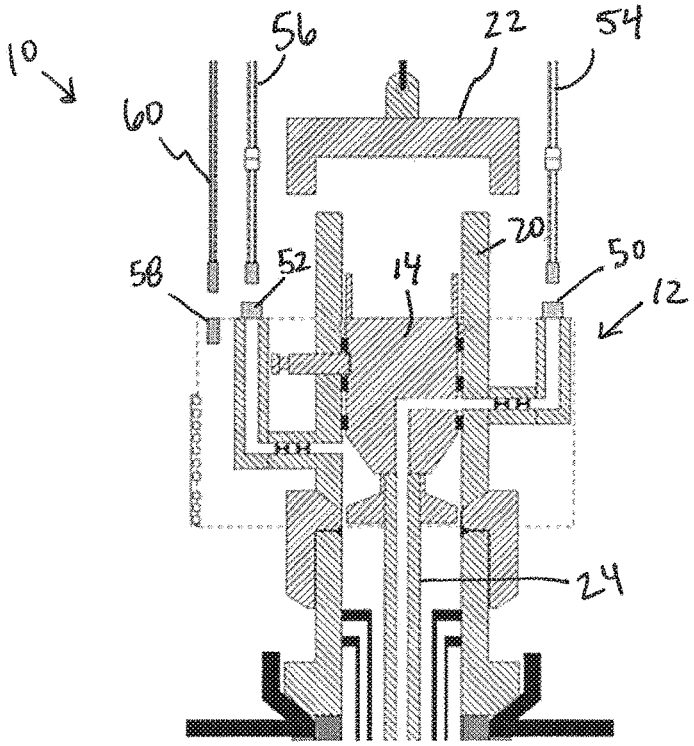
FIG. 6 is a schematic diagram of the subsea module and tool hanger of FIG. 1 with downlines, an umbilical, and a debris cap disconnected from the subsea module, in accordance with an embodiment of the present disclosure.
Figure 7:
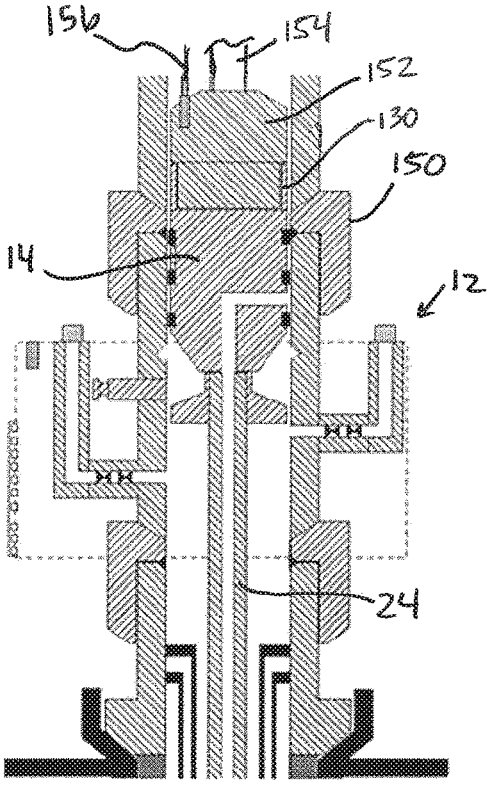
FIG. 7 is a schematic diagram of the tool hanger and in-well tool being pulled from the subsea module of FIG. 1 through a marine riser, in accordance with an embodiment of the present disclosure.

In contingency modes, the subsea module 12 may be shut in as a fail-safe. This could happen due to several reasons, such as an unexplained scenario developing in the well making it impossible to remove the subsea module 12 without exposing the well to the environment. During certain contingency operations, the downlines 54 and 56 and umbilicals 60 may be controllably disconnected from the subsea module 12 (if they are not already disconnected) along with the debris cap 22, as shown in FIG. 6. At this point, a BOP 150 may be deployed with a marine riser system and connected to the re-entry mandrel 20 of the subsea module 12, as shown in FIG. 7.

A contingency recovery tool 152 (running tool) may then be deployed on a suitable work string 154 to recover the tool hanger 14 and suspended in-well tool string 24 connected thereto. The contingency recovery tool 152 may interface with the contingency neck profile 130 of the tool hanger 14 and may be designed to release the tool hanger 14 from the subsea spool 16 mechanically without the need for a hydraulic supply. If needed, an umbilical 156 may be deployed inside the marine riser to hydraulically disengage the tool hanger 14 from the subsea spool 16 via the contingency recovery tool 152. Releasing the tool hanger 14 from the spool 16 may involve deactivating the seals 86 between the tool hanger 14 and the spool 16, disengaging the locking arrangement 74 between the tool hanger 14 and the internal bore surface of the spool 16, and removing the line connection system 110 of the subsea module 12 from the receptacle in the tool hanger 14.

Figure 8:
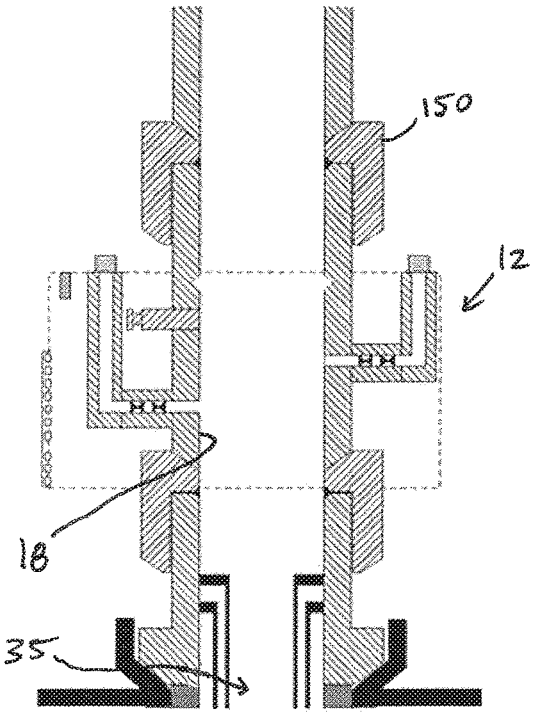
FIG. 8 is a schematic diagram of the subsea module of FIG. 1 with the tool hanger and in-well tool completely removed, in accordance with an embodiment of the present disclosure.

Once disconnected from the subsea module 12, the tool hanger 14 and connected in-well tool string 24 may be pulled to the surface through the marine riser system, leaving the main bore 18 of the subsea module 12 open to the wellbore 35 as shown in FIG. 8. Applicable tooling for performing the desired contingency operation may then be run into the well through the BOP 150. During this process, the subsea module 12 remains sealably coupled to the wellhead 26 and provides the required fluid barriers via the barrier devices 48.

Turning back to FIG. 1, in some embodiments, the subsea module 12 may provide subsea accumulation (hydraulic/electrical) for the barrier devices 48 and the downline disconnect functionality of the subsea module 12 to simplify the design of the umbilical 60. Furthermore, wireless communication (e.g., acoustic communication) from the vessel and/or an ROV to the subsea module 12 may be incorporated to allow for remote activation of the barrier valves 48 and disconnect functions of the downlines 54 and 56 and/or umbilical 60 terminated on the subsea module 12.

Figure 9:
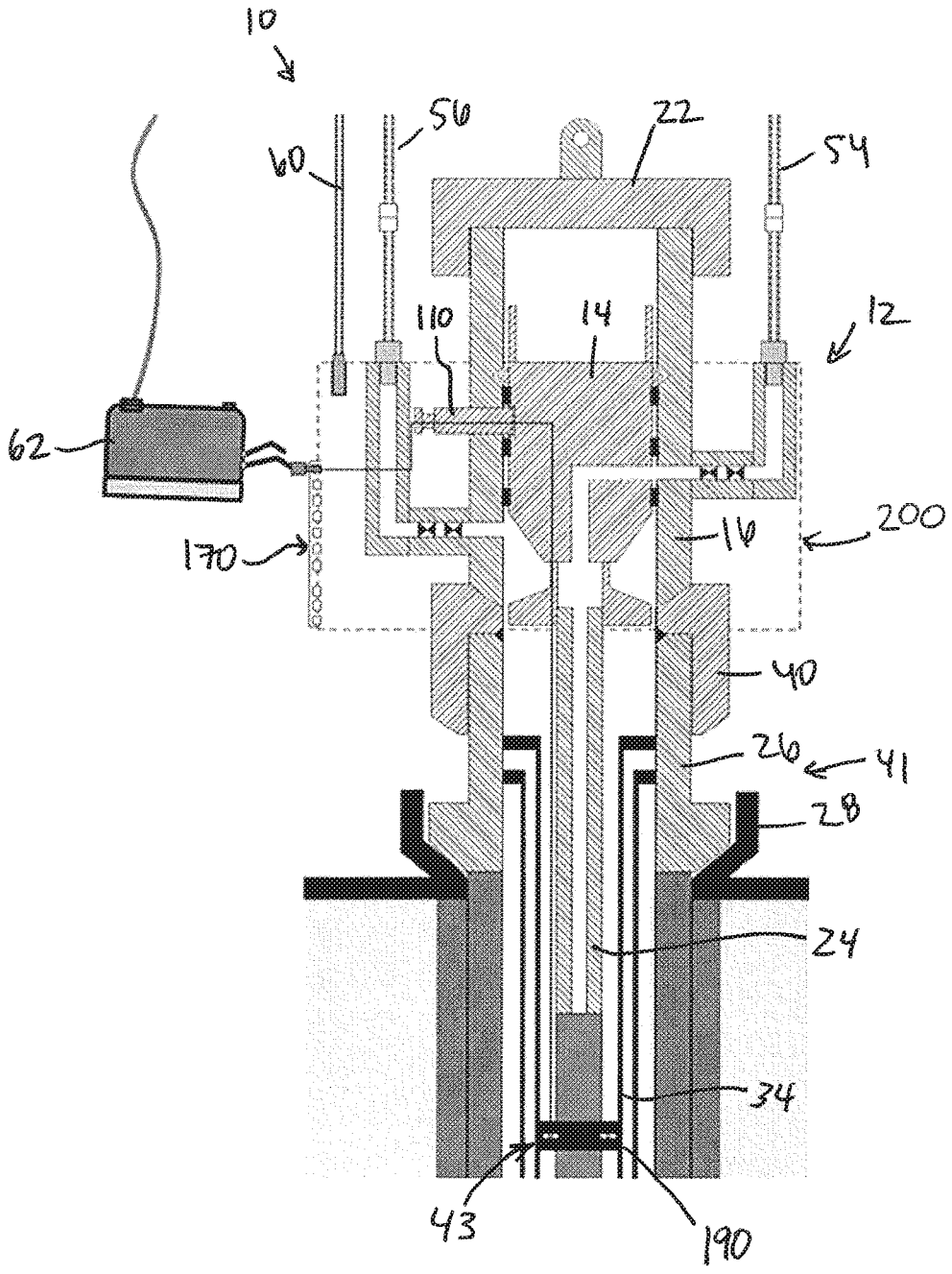
FIG. 9 is a schematic diagram of an ROV interacting with the subsea module of FIG. 1 to inflate or deflate a packer system mounted on the in-well tool, in accordance with an embodiment of the present disclosure.
Figure 10:
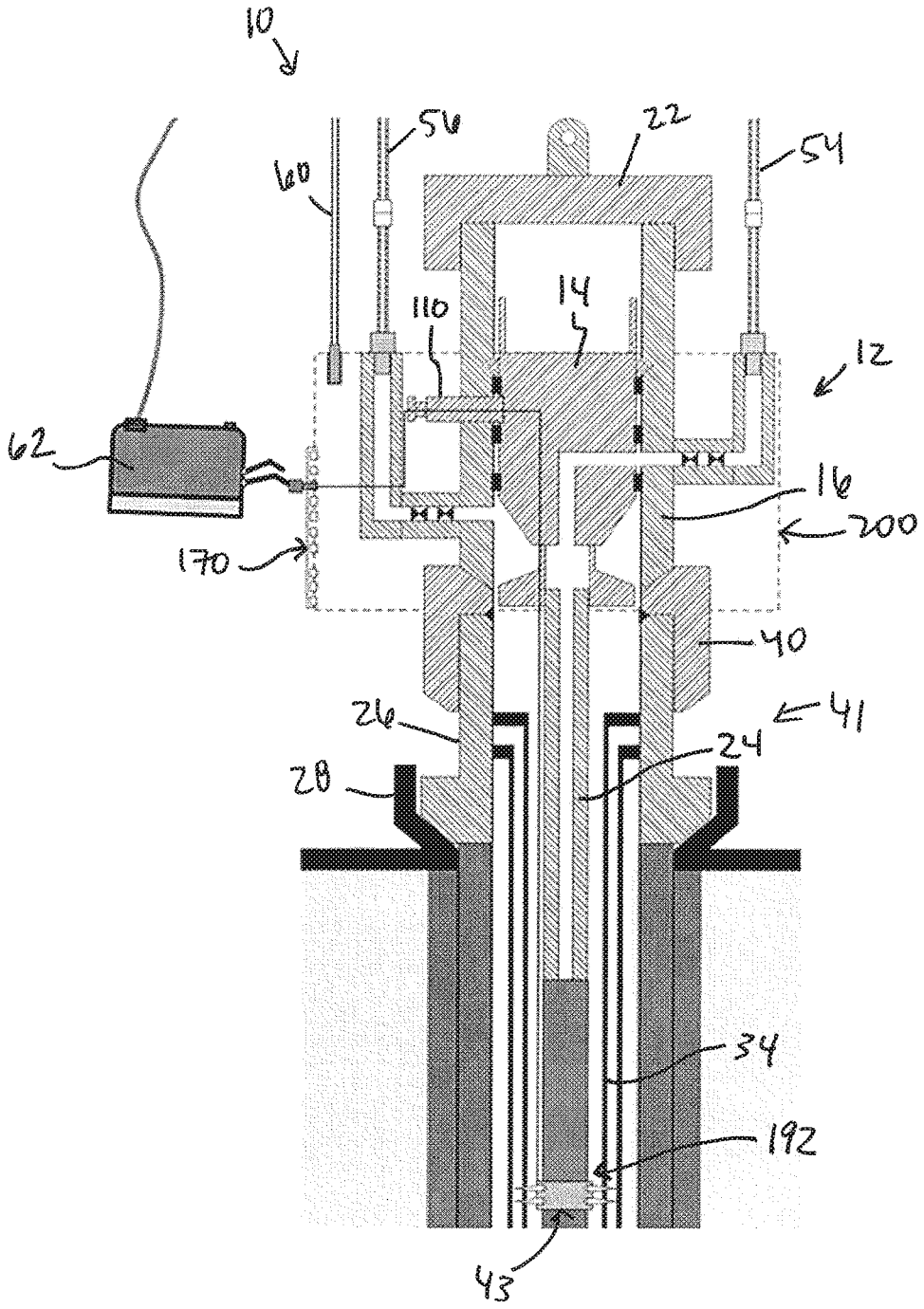
FIG. 10 is a schematic diagram of an ROV interacting with the subsea module of FIG. 1 to activate a perforating gun on the in-well tool, in accordance with an embodiment of the present disclosure.

One or more ROV panels 170 may be included on the subsea module 12, as shown. The ROV panels 170 may be equipped with electrical, hydraulic, and/or fiber connections designed to communicate directly to equipment installed on the subsea module 12, or to the in-well tool string 24 via the line connection system 110. As an example, FIGS. 9 and 10 illustrate an ROV 62 being used to actuate various components on the in-well tool 43 suspended from the tool hanger 14 via the in-well tool string 24. In FIG. 9, the ROV 62 may stab into the ROV panel 170 of the subsea module 12 and communicatively interface with the in-well tool string 24 via the line connection system 110 to provide control signals to inflate one or more packer elements 190 of the in-well tool string 24. This inflation of the packer 190 may seal off the annulus between the in-well tool string 24 and the casing 34, as shown. In FIG. 10, the ROV 62 may stab into the ROV panel 170 of the subsea module 12 and communicatively interface with the in-well tool string 24 via the line connection system 110 to provide control signals to fire a perforating gun 192 of the in-well tool string 24. This firing of the perforating gun 192 may establish fluid communication between the in-well tool string 24 and one or more wellbore casing strings (e.g., 34), as shown. The disclosed system 10 may enable operational control and monitoring of the in-well tool string 24 by an ROV 62 using the ROV panel 170 on the subsea module 12 and the line connection system 110 connected across the subsea module 12 and the tool hanger 14.

As illustrated in FIG. 1, the subsea module 12 may further include a protective structure 200 designed to house and protect the internal components of the subsea module 12 therein. The ROV panel 170 may be disposed on an outside surface of the protective structure 200 for interfacing with the ROV 62. The various line and umbilical terminations (e.g., 50, 52, and 58) may be disposed through an upper surface of the protective structure 200 to connect the downlines 54 and 56 and umbilical 60 to the subsea module 12.

The debris cap 22 may be a standard debris cap used to protect the re-entry mandrel 20 of the subsea module 12 and the contingency neck profile 130 of the tool hanger 14 from marine growth when the system 10 is installed subsea. The debris cap 22 may be locked to the re-entry mandrel 20 and may be operated by the ROV 62. The debris cap 22 may also serve as a running and recovery tool for the complete system 10 (subsea module 12, tool hanger 14 with the suspended in-well tool string 24, downlines 54 and 56, and umbilical 60).

As shown, an upper surface of the debris cap 22 may be coupled to deployment wire 202, which may be used to deploy the system 10 from a vessel toward the subsea wellhead 26. The entire system 10 may be pre-assembled on the vessel, which may be a multi-purpose vessel that is not equipped with a moon pool and/or derrick. The pre-assembled system 10 may then be lowered in one trip to the sea floor via the deployment wire 202 for insertion into the wellbore 35 and attachment to the wellhead 26 or other subsea component.

Figure 11:
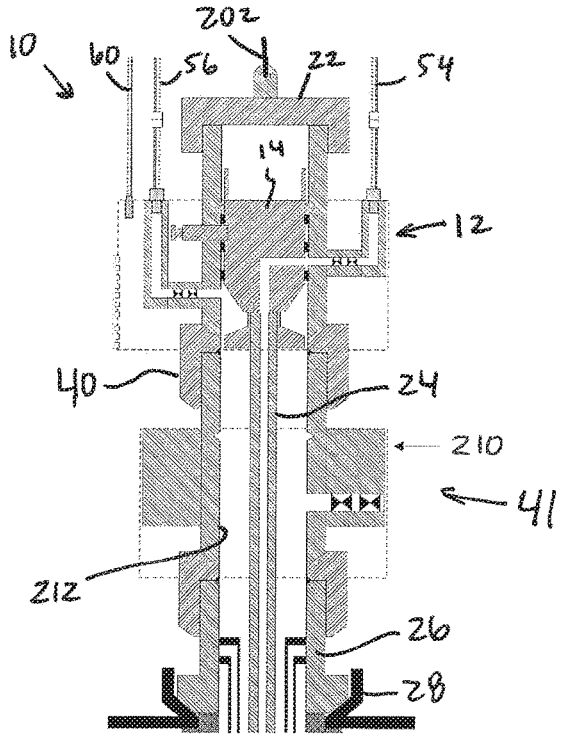
FIG. 11 is a schematic diagram of the subsea module and tool hanger of FIG. 1 installed on a subsea tree, in accordance with an embodiment of the present disclosure.
Figure 12:
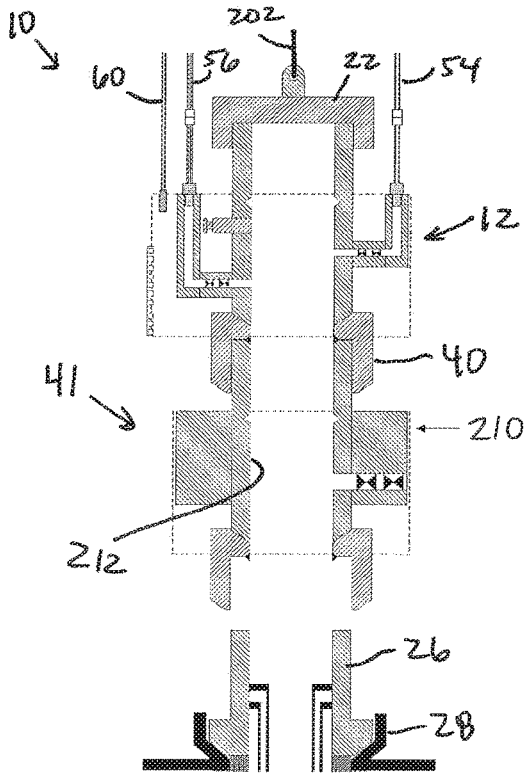
FIG. 12 is a schematic diagram of the subsea module of FIG. 11 being used to recover the subsea tree to the surface, in accordance with an embodiment of the present disclosure.

It should be noted that the subsea module 12 (with other connected equipment) may be installed directly onto the wellhead 26 (e.g., via the component connector 40), as shown in FIG. 1. However, in other instances the subsea module 12 may be installed directly onto other types of subsea components 41 such as a tubing spool and/or alternatively on a subsea tree via the appropriate component connector 40. FIG. 11 illustrates the disclosed system 10 including the subsea module 12 and tool hanger 14 installed onto a subsea tree 210. The subsea module 12 may be installed on a horizontal subsea tree 210, as shown, where the in-well tool string 24 straddles a vertical through bore 212 of the horizontal subsea tree spool. When installed on a subsea tree 210 in this manner, the subsea module 12 may be used as a tree recovery tool, as shown in FIG. 12. Specifically, the subsea module 12 may be used to recover the subsea tree 210 to the surface, with or without the tool hanger 14 and in-well tool string 24 present.

Figure 13:
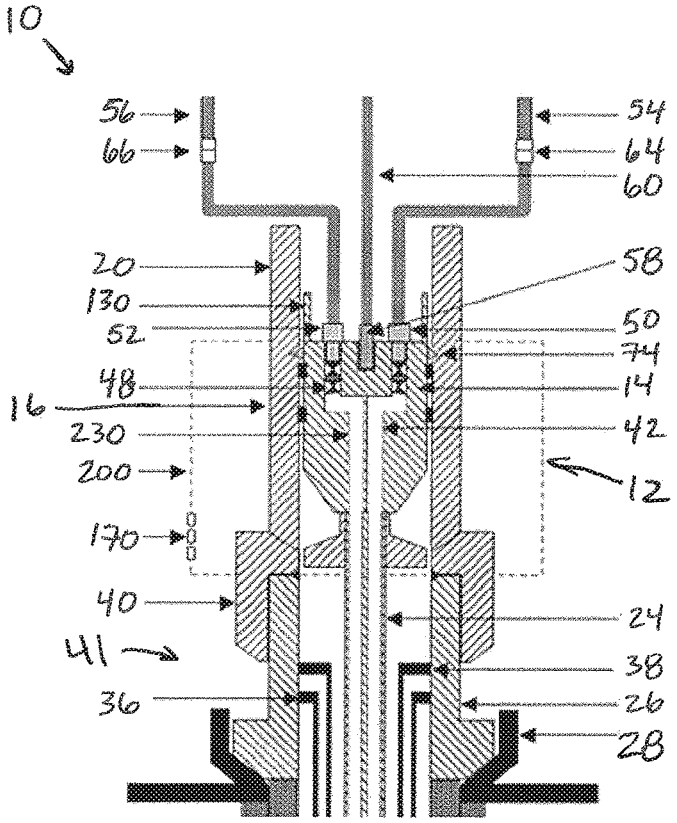
FIG. 13 is a schematic diagram of a subsea module with a tool hanger having downline and umbilical connections directly at the tool hanger, in accordance with an embodiment of the present disclosure.

Other configurations of the circulation lines and return lines formed through the subsea module 12 and/or the tool hanger 14 may be utilized in the disclosed system 10. For example, FIG. 13 illustrates an example system 10 where the circulation line 42 and a return line 230 are both routed through the tool hanger 14. The tool hanger 14 may also include various control interfaces, thereby enabling simplifications to the subsea module 12. With this configuration, one or multiple barriers devices 48 may be installed inside the tool hanger 14 in their respective bores to provide well control when installed. One or more downlines 54 and 56 and umbilicals 60 may be terminated at an exterior (e.g., top surface) of the tool hanger 14 with the same subsea disconnect and reconnect functionality as described for the previous system configuration. The tool hanger 14 may be furnished with sufficient sealing arrangements and locking mechanisms to securely fasten the tool hanger 14 to the spool wall of the subsea module 12. In addition, the tool hanger 14 may be furnished with the upper contingency neck profile 130 to which a recovery tool may be connected to allow for selective disconnection and recovery of the tool hanger 14 from the subsea module 12 through a BOP (as described above with reference to FIGS. 6-8).

Figure 14:
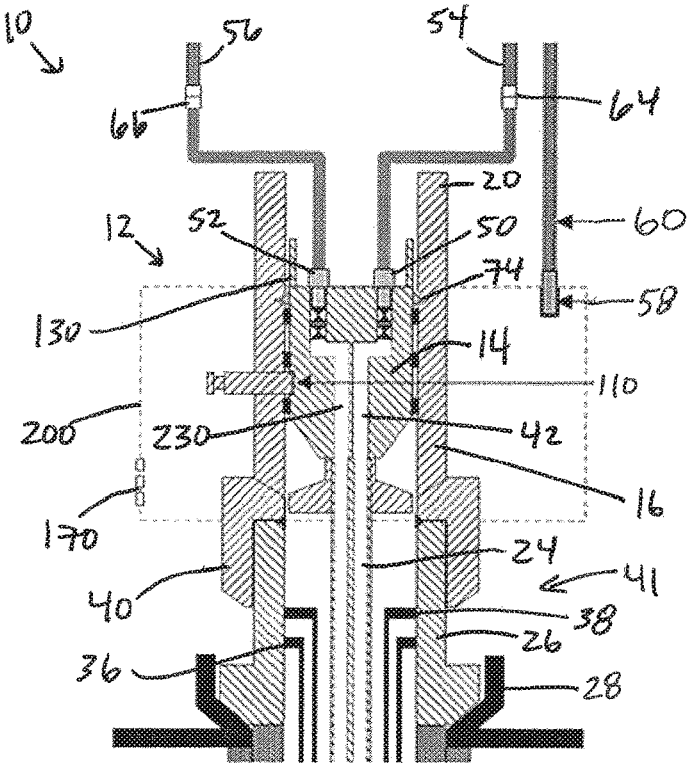
FIG. 14 is a schematic diagram of a subsea module with a tool hanger having an umbilical connection at the subsea module and downline connections at the tool hanger, in accordance with an embodiment of the present disclosure.

In another configuration shown in FIG. 14, the tool hanger 14 may include the circulation line 42 and return line 230 and the downlines 54 and 56 may be terminated directly at the tool hanger 14 (similar to the FIG. 13 configuration). However, the umbilical 60 may be terminated at the subsea module 12. That way, the umbilical 60 and subsea module 12 may supply control of in-well tool and tool hanger functions to the tool hanger 14 via the above described line connection system 110 disposed through the spool 16 of the subsea module 12.

Figure 15:
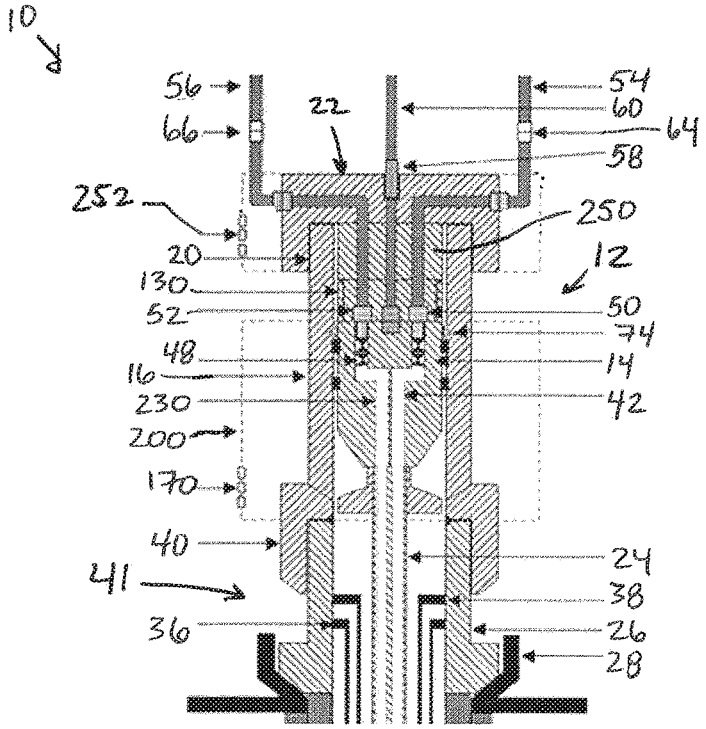
FIG. 15 is a schematic diagram of a subsea module with a tool hanger having downline and umbilical connections directly at the debris cap, in accordance with an embodiment of the present disclosure.

Another configuration, shown in FIG. 15, includes the system 10 with the downlines 54 and 56 and the umbilical 60 each terminated in the debris cap 22 rather than the subsea module 12. The debris cap 22 may in this instance include a stabbing feature 250 that engages with the top of the tool hanger 14 to interface with the circulation line 42, the return line 230, and the control features formed in the tool hanger 14. Thus, the debris cap 22 may enable the circulation downline 54, the return downline 56, and the umbilical 60 to communicate with the in-well tool string 24 to provide sufficient circulation functionality and control. The debris cap 22 may include an ROV panel 252 that is equipped with electrical, hydraulic, and/or fiber connections designed to communicate directly to the tool hanger 14 via the stabbing feature 250.

Figure 16:
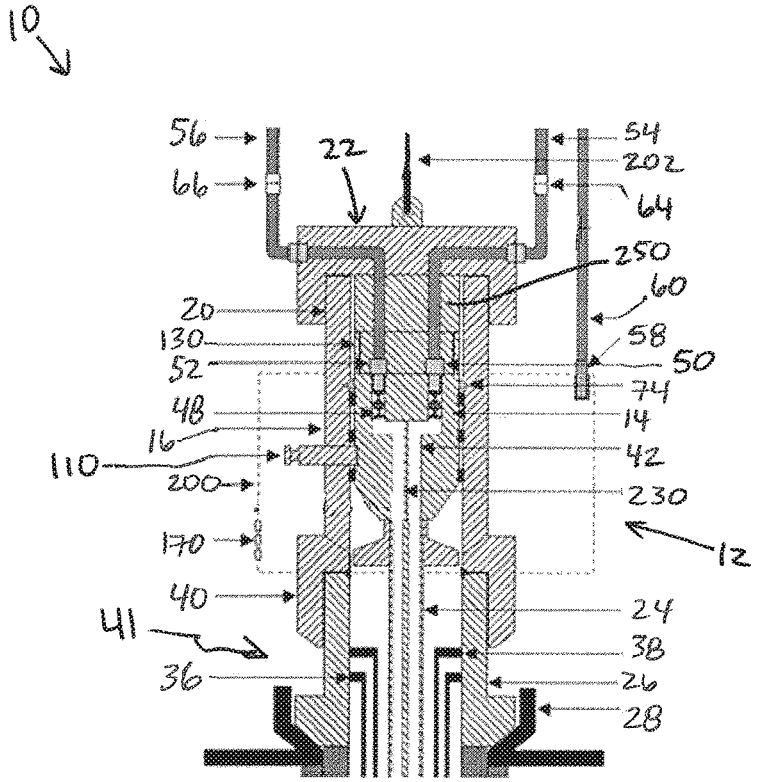
FIG. 16 is a schematic diagram of a subsea module with a tool hanger having an umbilical connection at the subsea module and downline connections at a debris cap, in accordance with an embodiment of the present disclosure.

In another configuration of the system 10, shown in FIG. 16, the downlines 54 and 56 may be terminated in the debris cap 22, while the umbilical 60 is terminated at the subsea module 12. In this instance, the debris cap 22 may include a stabbing feature 250 that engages with the top of the tool hanger 14 to interface with the circulation line 42 and the return line 230 (similar to the configuration of FIG. 15). The umbilical 60 and subsea module 12 may supply control of in-well tool and tool hanger functions to the tool hanger 14 via the above described line connection system 110 disposed through the spool 16 of the subsea module 12.

Figure 17:
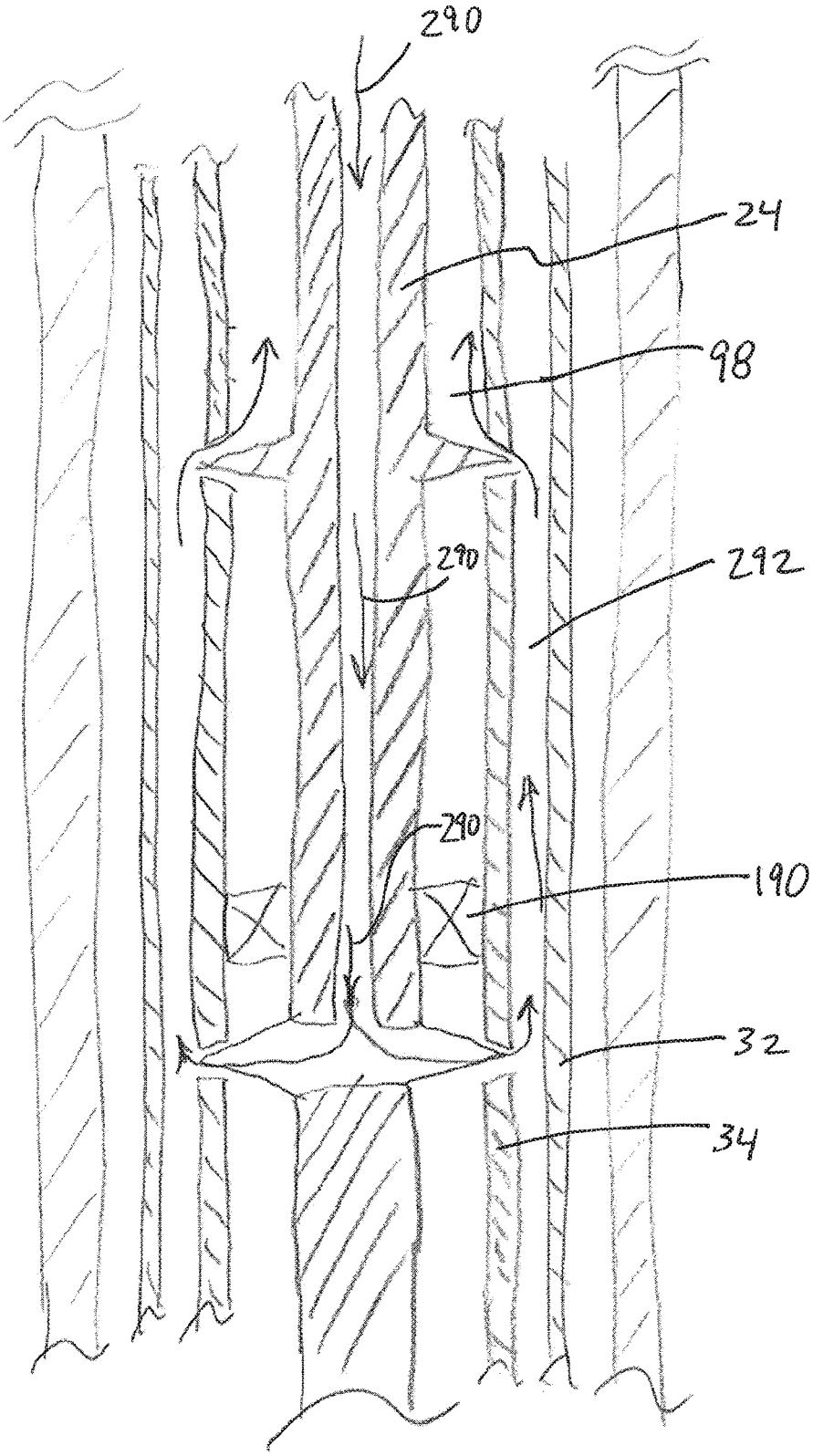
FIG. 17 is a schematic diagram illustrating the operation of the in-well tool of FIG. 1, in accordance with an embodiment of the present disclosure.
Figure 18D:
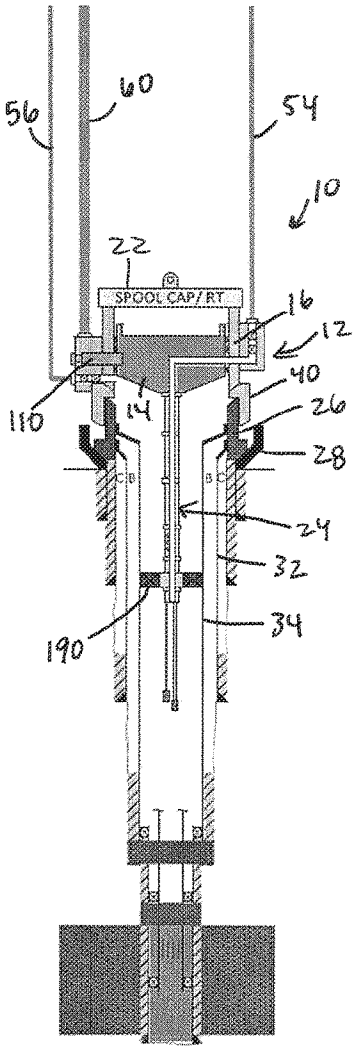
FIGS. 18A, 18B, 18C, and 18D are a series of schematic diagrams illustrating a method of installing the subsea module, tool hanger, and associated tool of FIG. 1 into a subsea well, in accordance with an embodiment of the present disclosure.
Figure 18C:
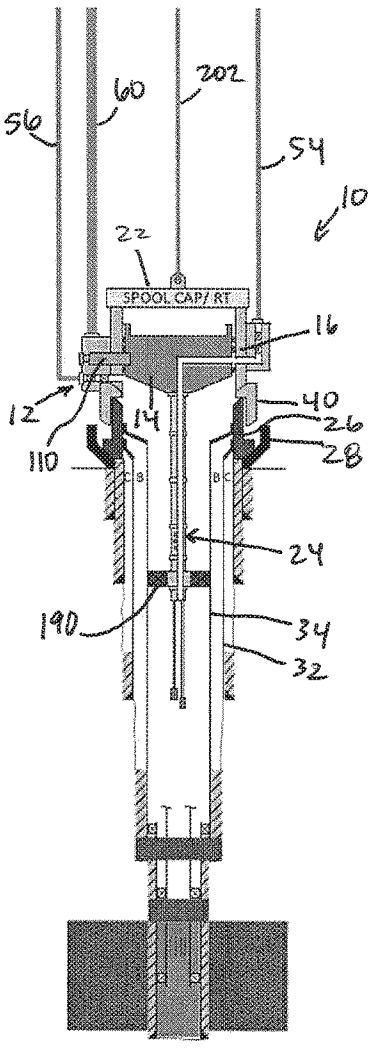
Figure 18B:
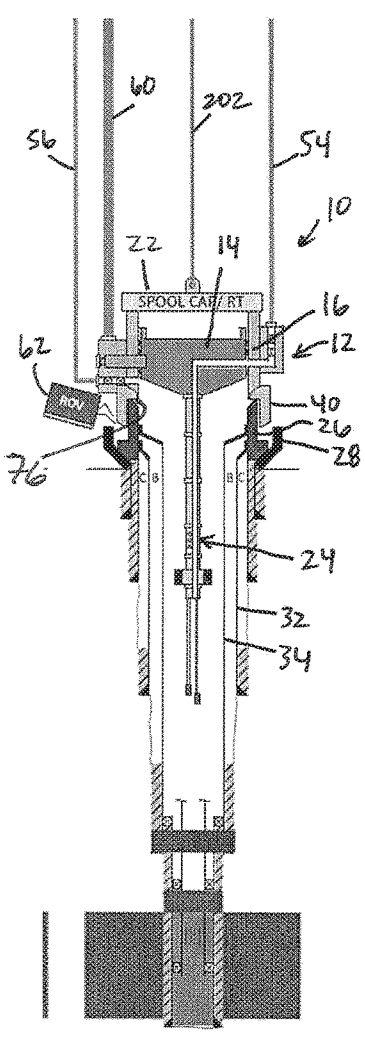
Figure 18A:
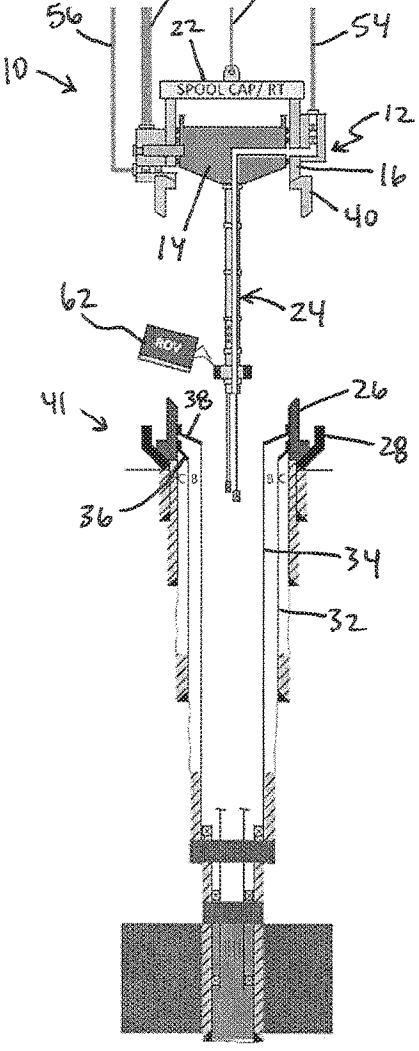

FIG. 17 illustrates an example downhole tool string 24 and the associated fluidic circuit coupling the circulation line 42 and the annulus 98 (or return line 230). The downhole tool string 24 may be configured to perforate the small bore casing 34 and to enable fluid circulation through the perforated section of casing 34 as shown. Flow down from the circulation line is shown by central arrows 290. Perforation of the casing 34 enables fluid to flow to an annulus 292 outside the casing 34 around the set packer 190, into the annulus 98 between the tool string 24 and the casing 34, and then subsequently up and out of the annulus 98 to the return line. This circulation of fluid through the wellbore via the downhole tool string 24 may facilitate plugging of the top of the well via cement or some other plugging media.

FIG. 18 illustrates a method of installing the disclosed system 10 onto existing subsea equipment, such as a wellhead 26 and/or subsea tree. In the illustrated example, the system 10 may be landed onto the wellhead 26 via the component connector 40. FIG. 18A shows the pre-assembled system 10 including the subsea module 12, tool hanger 14, and suspended in-well tool string 24 being lowered using the deployment wire 202 with the debris cap 22 acting as a dedicated running tool. The bottom of the in-well tool string 24 may be guided into the wellhead 26 and associated casing strings 32 and 34 via the ROV 62. In FIG. 18B, the spool 16 of the subsea module 12 is landed on the wellhead 26. The ROV 62 may interface with the system 10 (e.g., via a gripping mechanism and/or setting the seal 76) to lock the component connector 40 onto the wellhead 26 and to perform any necessary testing. The system 10 may be sealed against the wellhead 26 via the first seal (e.g., 76 of FIG. 1) between the component connector 40 and the wellhead 26. At FIG. 18C, the packer element 190 may be inflated toward the casing wall 34. As described above, the ROV 62 may stab into an ROV panel (e.g., 170 of FIG. 1) on the subsea module 12 to initiate the packer inflation via signals communicated through the line connection system 110. FIG. 18D shows the system 10 fully installed. At this point, the installed system 10 may perform a plug and abandonment operation on the well. Specifically, the ROV 62 or remote communications from the topside equipment (via umbilical 60) may be used to initiate perforations and circulation via the in-well tool 43. A plugging media (e.g., cement) may be circulated downhole via the circulation and return lines of the subsea module 12 and/or tool hanger 14 along with the downhole tool string 24, thereby setting a plug in the top of the wellbore 35 to cap off the well.

Figure 19C:
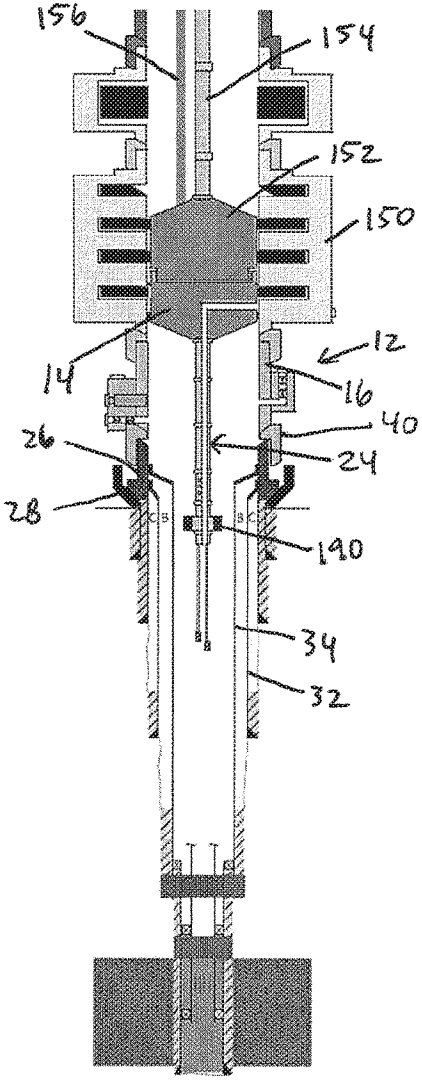
FIGS. 19A, 19B, and 19C are a series of schematic diagrams illustrating a method of performing a contingency operation without removing the subsea module of FIG. 1, in accordance with an embodiment of the present disclosure.
Figure 19B:
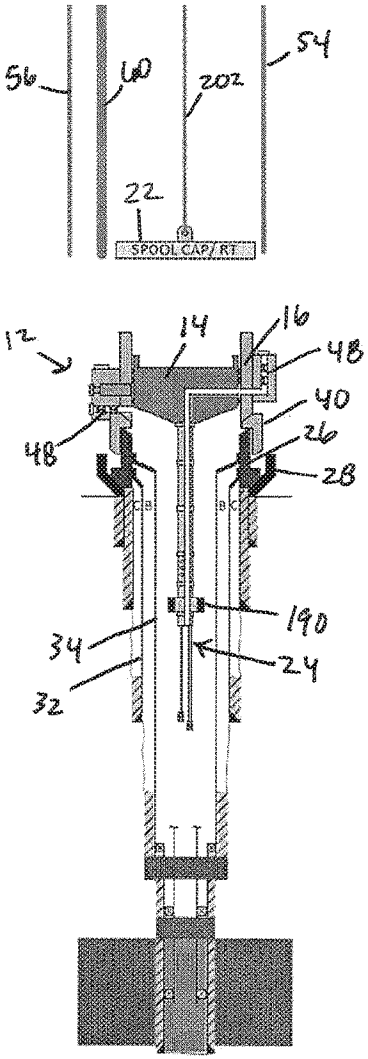
Figure 19A:
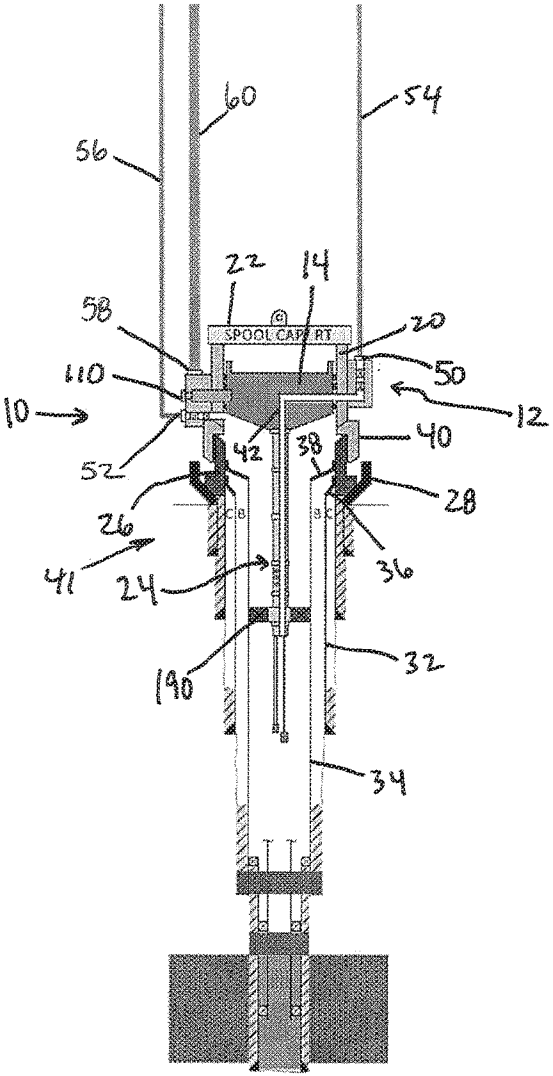

FIG. 19 illustrates a method for performing contingency operations using the disclosed system 10 in the event that a pressure seal disposed further down in the wellbore 35 is lost during the plug and abandonment operation. At FIG. 19A, an unexpected downhole operation (e.g., loss of a plug) requiring intervention may be detected while the subsea module 12, tool hanger 14, and in-well tool string 24 are securely positioned at the well. At FIG. 19B, the barrier valves 48 may be closed and the packer element 190 deflated in response to signals received either from the topside equipment or from an ROV. The downlines 54 and 56 and umbilical 60 may be detached from the top of the subsea module 12 along with the debris cap 22 and pulled to the surface. FIG. 19C shows the BOP 150 deployed and landed on top of the subsea spool 16 equipped with the re-entry mandrel 20. The contingency retrieval tool 152 may engage the tool hanger 14 and operate to unlock the tool hanger 14 from the subsea module 12 before pulling the tool hanger 14 and the suspended downhole tool string 24 to the surface. Thus, the disclosed subsea module 12 and tool hanger 14 may enable the possibility of removing a suspended in-well tool string 24 from the wellbore through the BOP 150 without also removing the subsea module 12 during contingency modes.

Although the present disclosure and its advantages have been described in detail, it should be understood that various changes, substitutions and alterations can be made herein without departing from the spirit and scope of the disclosure as defined by the following claims.

What is claimed is:

1. A method, comprising:

landing a subsea module on a subsea component, wherein the subsea module comprises a subsea spool with a main bore formed therethrough, wherein the subsea module is coupled to a tool hanger disposed within the main bore of the subsea spool, and wherein an in-well tool string extends downward from the tool hanger, the in-well tool string suspending an in-well tool within a wellbore of a production well;

sealing a first seal of the subsea module to the subsea component;

sealing the tool hanger against the main bore of the subsea spool via at least a second seal;

operating the in-well tool string and the in-well tool to carry out a plug and abandonment operation;

communicating signals to the tool hanger via a line connection system coupling the subsea spool to the tool hanger;

communicating the signals through the tool hanger and the in-well tool string to the in-well tool coupled to the tool hanger via the in-well tool string; and actuating the in-well tool in response to the signals.

2. The method of claim 1, wherein the step of communicating signals to the tool hanger comprises communicating signals to the tool hanger from an ROV panel or an umbilical termination.

3. The method of claim 1, wherein the step of actuating the in-well tool comprises at least one of:

perforating a downhole tubular with the in-well tool, sealing an annulus between the downhole tubular and the in-well tool string by means of a sealing element, and filling a downhole volume with a plugging medium through the in-well tool string.

4. A method, comprising:

landing a subsea module on a subsea component, wherein the subsea module comprises a subsea spool with a main bore formed therethrough, wherein the subsea module is coupled to a tool hanger disposed within the main bore of the subsea spool, and wherein an in-well tool string extends downward from the tool hanger, the in-well tool string suspending an in-well tool within a wellbore of a production well;

sealing a first seal of the subsea module to the subsea component;

sealing the tool hanger against the main bore of the subsea spool via at least a second seal;

operating the in-well tool string and the in-well tool to carry out a plug and abandonment operation;

landing a blowout preventer on the subsea spool;

disengaging the tool hanger from the subsea spool; and retrieving the tool hanger and connected in-well tool string through the blowout preventer and toward the surface while the subsea module remains disposed on the subsea component.

5. The method of claim 1, further comprising the step of filling a downhole volume with a plugging media via the in-well tool string.

6. The method of claim 1, further comprising operating the in-well tool to perforate a casing in the wellbore and circulate fluid via the in-well tool string and through a perforated section.

7. The method of claim 1, further comprising operating the in-well tool to cap the wellbore.

8. The method of claim 1, further comprising providing fluid to the in-well tool string or to spaces surrounding the in-well tool string via a circulation line in the tool hanger.

9. The method of claim 8, wherein the step of providing fluid comprises providing the fluid via a circulation block in the subsea module.

10. The method of claim 9, further comprising providing a return flow of fluid from the wellbore via a return block in the subsea module.

* * * * *